US010012058B2

(12) United States Patent
Bennett

(10) Patent No.: US 10,012,058 B2
(45) Date of Patent: Jul. 3, 2018

(54) EXPANSION SYSTEM

(71) Applicant: ENVENTURE GLOBAL TECHNOLOGY, LLC, Houston, TX (US)

(72) Inventor: Frederick Cornell Bennett, Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 0 days.

(21) Appl. No.: 15/511,440

(22) PCT Filed: Sep. 15, 2015

(86) PCT No.: PCT/US2015/050090
§ 371 (c)(1),
(2) Date: Mar. 15, 2017

(87) PCT Pub. No.: WO2016/044209
PCT Pub. Date: Mar. 24, 2016

(65) Prior Publication Data

US 2017/0284176 A1 Oct. 5, 2017

Related U.S. Application Data

(60) Provisional application No. 62/050,482, filed on Sep. 15, 2014.

(51) Int. Cl.
*E21B 43/10* (2006.01)
*E21B 19/00* (2006.01)

(52) U.S. Cl.
CPC ..... *E21B 43/105* (2013.01); *E21B 19/00* (2013.01); *E21B 43/108* (2013.01)

(58) Field of Classification Search
CPC ..... E21B 43/105; E21B 43/108; E21B 19/00
USPC ..... 166/380
See application file for complete search history.

(56) References Cited

U.S. PATENT DOCUMENTS

2005/0056434 A1 3/2005 Watson et al.
2005/0194129 A1 9/2005 Campo
2006/0096762 A1 5/2006 Brisco
2006/0162938 A1 7/2006 Lohbeck et al.
2006/0243444 A1* 11/2006 Brisco ..... E21B 21/10 166/298
2008/0156499 A1 7/2008 Giroux et al.
2008/0223568 A1 9/2008 Roggeband et al.
2012/0037381 A1* 2/2012 Giroux ..... E21B 23/01 166/382
2012/0152567 A1 6/2012 Whiddon et al.
(Continued)

OTHER PUBLICATIONS

Search Report and Written Opinion for corresponding application PCT/US2015/050090 dated Dec. 10, 2015; 11 pages.

*Primary Examiner* — Taras P Bemko
(74) *Attorney, Agent, or Firm* — Jonathan M. Pierce; Porter Hedges LLP

(57) ABSTRACT

A system includes an inner string assembly disposed within an outer casing. The inner string assembly includes a seal member in sealing engagement with the outer casing. An expansion sleeve is coupled to an end of the outer casing. An expandable liner is coupled to the expansion sleeve. A cone assembly is coupled to the inner string assembly and positioned proximate to the expansion sleeve when the inner string is in a running position.

14 Claims, 3 Drawing Sheets

(56) References Cited

U.S. PATENT DOCUMENTS

2014/0054047 A1* 2/2014 Zhou ..... E21B 43/106
166/382

* cited by examiner

EXPANSION SYSTEM

CROSS-REFERENCE TO RELATED APPLICATIONS

This application is filed under 35 U.S.C. § 371 as a national phase entry of PCT/US2015/050090, which claims the benefit under 35 U.S.C. § 119(e) of U.S. Provisional Patent Application No. 62/050,482 filed Sep. 15, 2014, the disclosure of which is hereby incorporated herein by reference for all purposes.

BACKGROUND

This disclosure relates generally to methods and apparatus for expanding wellbore tubular members, such as casing, liners, and the like. More specifically, this disclosure relates to methods and apparatus for expanding a first section of expandable tubular to an inside diameter that allows a second section of expandable tubular and expansion assembly to pass through the previously expanded section and then be expanded to the same inside diameter.

In the oil and gas industry, expandable tubing is often used for casing, liners and the like. To create a casing, for example, a tubular member is installed in a wellbore and subsequently expanded by displacing an expansion cone through the tubular member. The expansion cone may be pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial force, the tubular member plastically deforms, thereby permanently increasing both its inner and outer diameters. In other words, the tubular member expands radially. Expandable tubulars may also be used to repair, seal, or remediate existing casing that has been perforated, parted, corroded, or otherwise damaged since installation.

In certain application, it may be desirable to install a series of expanded tubular sections having the same inside diameter. Many prior art expansion systems are sized so that the maximum diameter of the expansion system in a running configuration, together with a new tubular to be expanded, is too large to pass through a previously expanded tubular section and a smaller diameter system has to be used.

Thus, there is a continuing need in the art for methods and apparatus for expansion systems and methods that overcome these and other limitations of the prior art.

BRIEF SUMMARY OF THE DISCLOSURE

In some aspects, a system comprises an outer casing, and an inner string assembly, and the inner string assembly includes a seal member in sealing engagement with the outer casing. The system further comprises an expansion sleeve that is coupled to an end of the outer casing. The system further comprises an expandable tubular that is coupled to the expansion sleeve. The system further comprises a cone assembly that is coupled to the inner string assembly. The cone assembly is positioned proximate to the expansion sleeve when the inner string is in a running position. The expansion sleeve may slots or holes that reduce a hoop strength of the expansion sleeve. The expansion sleeve may comprise a material that has a strength lower than a strength of the expandable tubular. The cone assembly may comprise an expansion cone and a shoe latch. The expansion cone may comprise an inner cone engaging cone segments to shift the expansion cone from a collapsed configuration to an expansion configuration. In the expansion configuration, the expansion cone may have an outer diameter that is greater than an outer diameter of the outer casing. The expandable tubular may be an expandable liner. The system may further comprise a safety sub assembly that is coupled to an upper end of the outer casing and that includes a coupling for connection to a conveyance. The system may further comprise a throughbore to circulate drilling fluid through the system. The system may further comprise a receptacle that is disposed in the inner string assembly along the throughbore and that is to be engaged by an activation member dropped from surface.

In some aspects, a system comprises an expansion assembly, an expansion sleeve that is coupled to an end of the expansion assembly, an expandable tubular that is coupled to the expansion sleeve, and a cone assembly that is coupled to the expansion assembly. The cone assembly is positioned proximate to the expansion sleeve when the expansion system is in a running position. The expansion sleeve may comprise slots or holes that reduce a hoop strength of the expansion sleeve. The expansion sleeve may comprise a material that has a strength lower than a strength of the expandable tubular.

In some aspects, a method involves assembling an expansion system comprising an outer casing, and an inner string assembly that includes a seal member in sealing engagement with the outer casing. The method further involves coupling a first expansion sleeve coupled to an end of the expansion system. The method further involves coupling a cone assembly to the expansion system. The cone assembly is positioned proximate to the first expansion sleeve when the expansion system is in a running position. The method further involves coupling a first expandable tubular to the first expansion sleeve, connecting the expansion system to a conveyance, positioning the first expandable tubular in a wellbore with the conveyance, and expanding the first expandable tubular in the wellbore to an expanded diameter. The method may further involve shifting an expansion cone of the cone assembly from a collapsed configuration to an expansion configuration in which the expansion cone has an outer diameter that is greater than an outer diameter of the outer casing. The method may further involve passing the expansion cone out of the first expandable tubular and collapsing the expansion cone. The method may further involve pulling the expansion system to surface, coupling a second expansion sleeve to the expansion system, coupling a second expandable tubular to the second expansion sleeve, and passing the expansion system and the second expandable tubular through the first expandable tubular. The method may further involve expanding the second tubular to the expanded diameter. The first expansion sleeve may comprise slots or holes that reduce a hoop strength of the first expansion sleeve. The first expansion sleeve may comprise a material that has a strength lower than a strength of the first expandable tubular.

BRIEF DESCRIPTION OF THE DRAWINGS

For a more detailed description of the embodiments of the present disclosure, reference will now be made to the accompanying drawings, wherein.

DETAILED DESCRIPTION

Figure 1A:
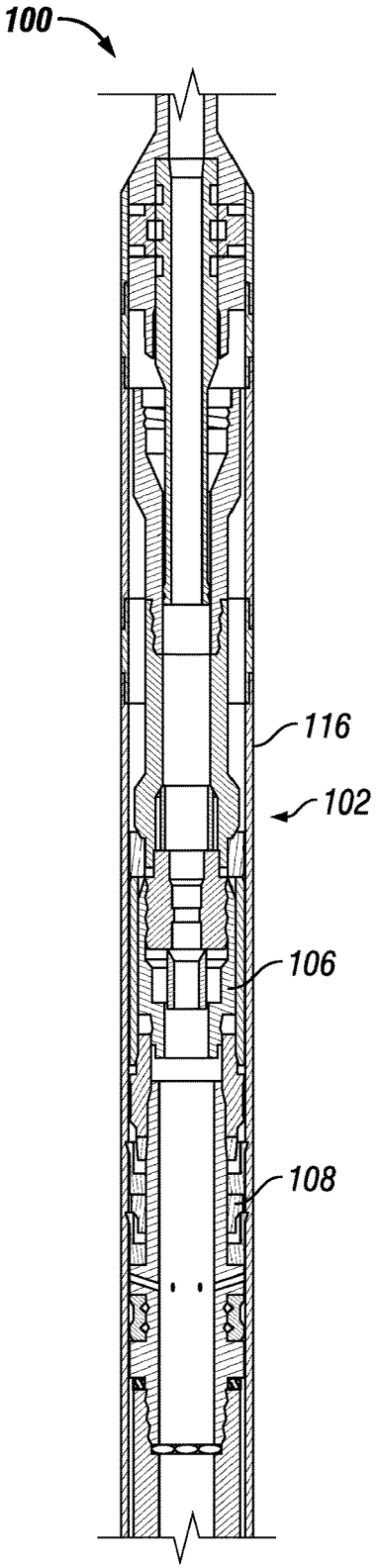
FIGS. 1A-1C are partial sectional views of an expandable system including an expandable liner and an expansion assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 1B:
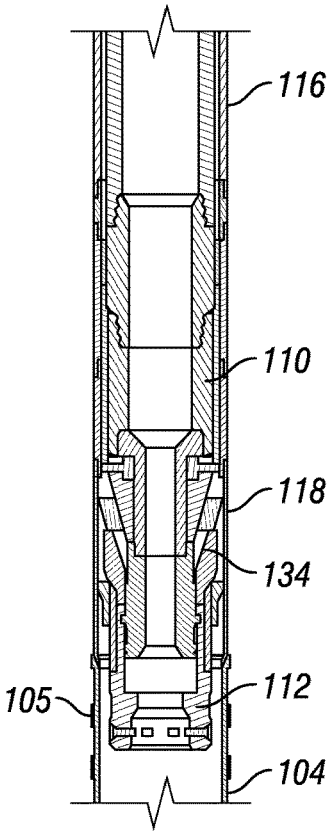
Figure 1C:
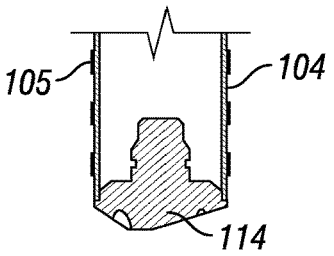

Referring initially to FIGS. 1A-1C, the expandable system 100 includes an expansion assembly 102 and an expandable liner 104. The expansion assembly 102 includes an inner string assembly 106 disposed partially within an outer casing 116. The inner string assembly 106 has a seal member 108 that is sealingly engaged with the outer casing 116. A cone assembly 110 is disposed on a lower end of the inner string assembly 106 and includes an expansion cone 134 and a shoe latch 112. A shoe 114 is coupled to a lower end of the expandable liner 104.

An expansion sleeve 118 is coupled to a lower end of the outer casing 116 and to an upper end of the expandable liner 104. When the expandable system 100 is fully assembled, the expansion sleeve 118 is positioned proximate the expansion cone 134. As will be explained in detail to follow, the expansion sleeve 118 is formed from a low hoop strength structure that can be easily expanded. In operation, the expansion sleeve 118 provides a location in which the expansion cone 134 can be shifted from a collapsed configuration to an expansion configuration. Once the expansion cone 134 is fully formed in the expansion configuration, it can be moved axially through the expandable liner 104, which results in plastic deformation and radial expansion of the expandable liner 104.

In certain embodiments, the expansion sleeve 118 and the expansion cone 134 may allow for an increased expanded diameter to be formed in an upper end of the expandable liner 104. When shifted in the expansion configuration, the expansion cone 134 may have an outer diameter that is greater than the outer diameter of the outer casing 116. The increased expanded diameter may be such that the inner diameter of the expandable liner 104 is greater than the outer diameter of the outer casing 116. Further, the increased expanded diameter may be such that the inner diameter of the expandable liner 104 is equal or greater than an inner diameter of another section of expandable liner already installed in a wellbore. Thus, the expandable liner 104 may be expanded to an inside diameter that allows another expandable system similar to expandable system 100 to pass through the expandable liner 104 and then be expanded to the same inside diameter as the expandable liner 104.

As will be explained in detail to follow, the expandable system 100 installs the expandable liner 104 by using hydraulic pressure to move the inner string assembly 106 axially relative to the expandable liner 104. The sealing engagement of the seal member 108 and the outer casing 116 essentially creates a differential pressure that moves the inner string assembly 106 relative to the expandable liner 104. This movement is used to both form the expansion cone 134 and move the expansion cone 134 through the expandable liner 104.

The installation of the expandable liner 104 by expandable system 100 is illustrated in FIGS. 2A-2F. The expandable system 100 is assembled by coupling the shoe 114 to the expandable liner 104. In certain embodiments, the expandable liner 104 may have one or more sealing bands 105 made from an elastomer or other materials for enhancing sealing engagement with a wellbore wall. The cone assembly 110 and expansion sleeve 118 are then coupled to the expandable liner 104 and to the outer casing 116. The inner string assembly 106 is made up and then inserted into the outer casing 116 and coupled to the cone assembly 110. A safety sub assembly 140 is coupled to the upper end of the outer casing 116 and includes a coupling 142 that allows for connection to a coiled tubing string, or work string, or other conveyance permitting circulation of drilling fluid (not shown).

Figure 2A:
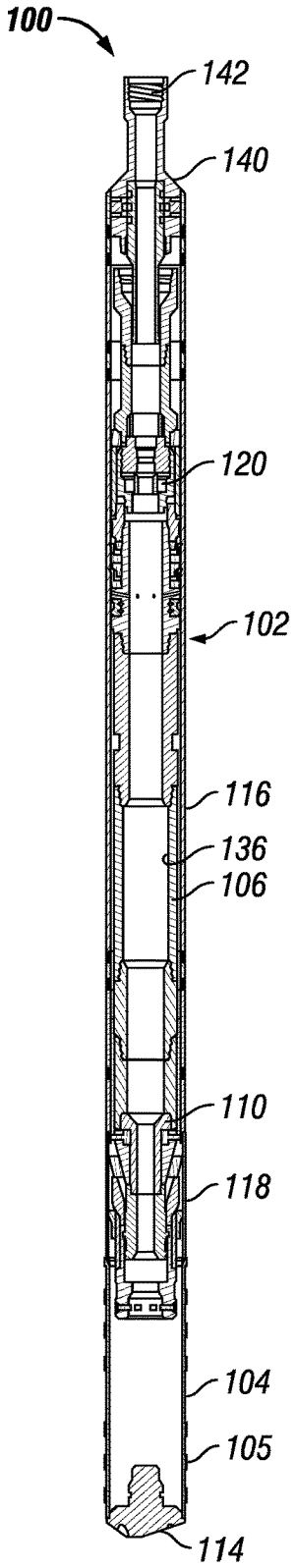
FIGS. 2A-2F illustrate the installation of an expandable liner using the expansion assembly of FIGS. 1A-1C.
Figure 2B:
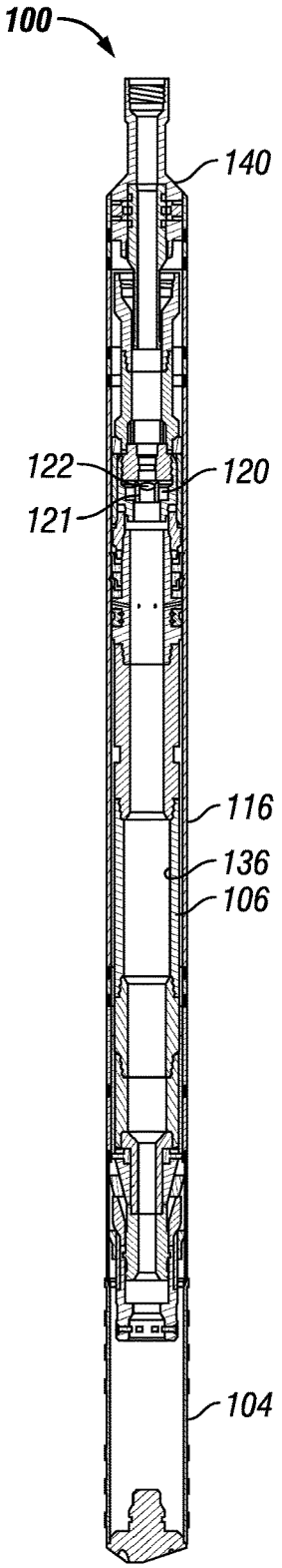
Figure 2C:
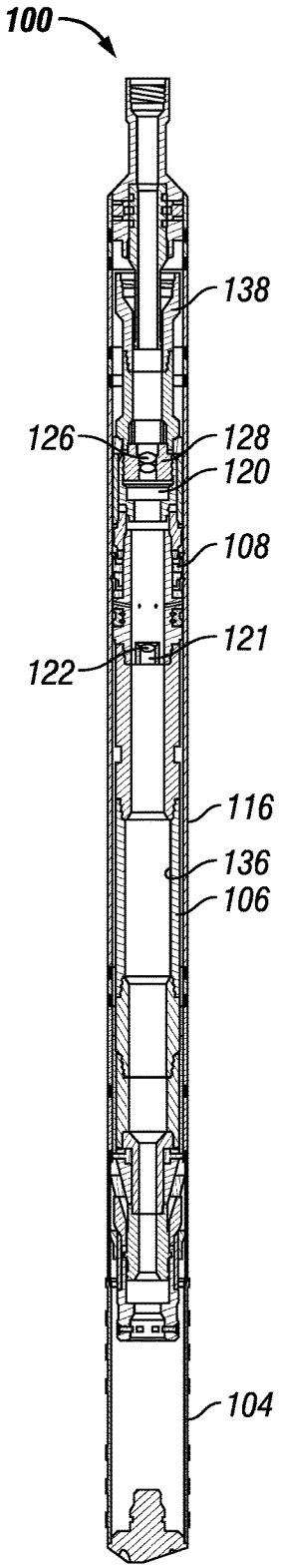

The assembled expandable system 100, as shown in FIG. 2A, is then run into a wellbore so that the expandable liner 104 is positioned in a desired location. The length of the expandable liner 104 can be selected based on wellbore conditions and the length of the wellbore sought to be covered by the expandable liner 104. The length of the outer casing 116 and inner string assembly 106 can be increased or decreased in proportion to the length of the expandable liner 104 being expanded.

The expandable system 100 includes a throughbore 136 that allows drilling fluid to be circulated from the surface, from a work string or other conveyance (not shown), and then through the expandable system 100 prior to setting the expandable liner 104. Once the expandable system 100 is positioned at the desired location in the wellbore, a ball 122 is dropped from the surface that travels for example through a work string (not shown) to the expandable system 100. The ball 122 moves through the throughbore 136, until it engages a shear tube 121. As assembled, the shear tube 121 is releasably coupled to the inner string assembly 106 in a position that maintains a flapper valve 120 in an open position.

Once the ball 122 lands in the shear tube 121, hydraulic pressure within the throughbore 136 will detach the shear tube 121 from the inner string assembly 106. Once detached, the shear tube 121 and ball 122 will move along the throughbore 136 to a position where the flapper valve 120 is allowed to close. The closure of the flapper valve 120 prevents fluid from moving upward through the throughbore 136 from below the flapper valve 120. In certain embodiments, other types of selectively closable valves may be used as alternatives to the flapper valve 120.

After the ball 122 is dropped, an activation member 126 is dropped through the work string or other conveyance to the expandable system 100. The activation member 126 may be a dart, ball, or other type of droppable sealing member. The activation member 126 engages a receptacle 128 disposed in the inner string assembly 106 along the throughbore 136 and creates a seal across the throughbore 136. Once flapper valve 120 is closed and the activation member 126 is in place, the flow of fluid through throughbore 136 is blocked in both directions.

With fluid flow through the throughbore 136 blocked, the receptacle 128 moves and opens up ports that allow fluid to flow into an annulus 138 between the outer casing 116 and the inner string assembly 106. As fluid moves into the annulus 138, a pressure differential across sealing member 108 will cause the inner string assembly 106 to move toward the expandable liner 104.

Figure 2D:
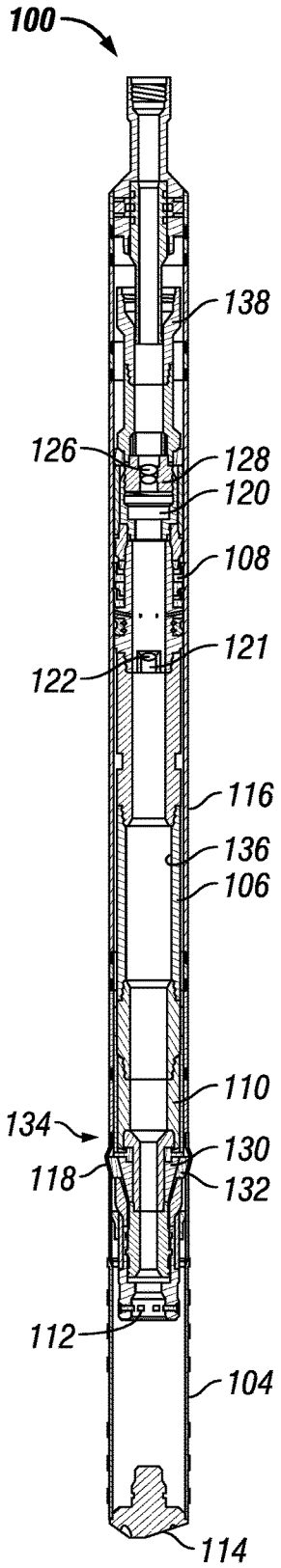
Figure 2E:
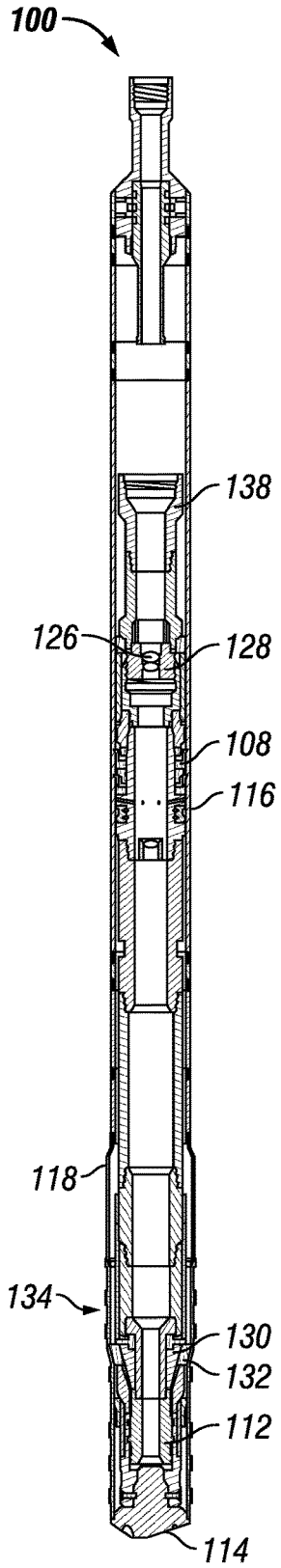
Figure 2F:
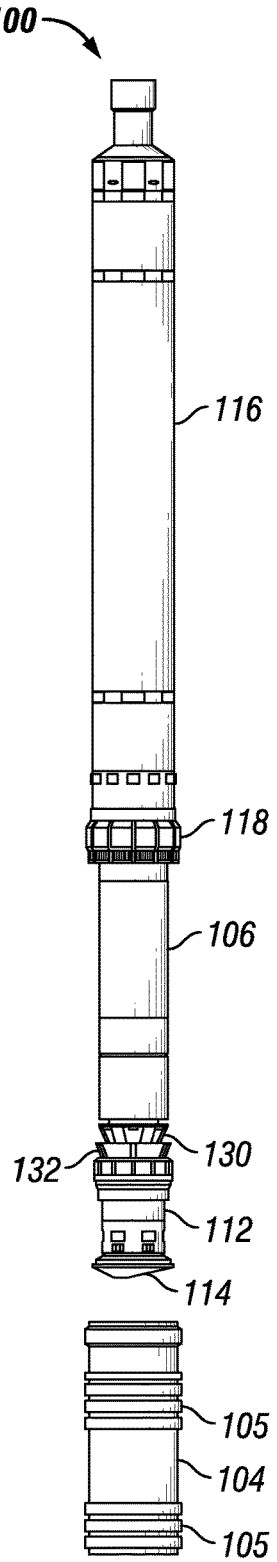

As inner string assembly 106 moves toward the expandable liner 104, the cone assembly 110 is activated so as to form an expansion cone 134, as shown in FIG. 2D. The expansion cone 134 is formed by an inner cone 130 moving downward and engaging cone segments 132. When formed, the expansion cone 134 is disposed within the expansion sleeve 118. Expansion sleeve 118 is formed from a structure having reduced hoop strength so as to facilitate forming the expansion cone 134. In certain embodiments, the expansion sleeve 118 may be formed from a low strength material or from a structure having slots, holes, or other features that reduce the hoop strength of the expansion sleeve 118.

In some embodiments, the expansion sleeve 118 has a hoop strength that is less than the hoop strength of the expandable liner 104, for example less than 80% of the hoop strength of the expandable liner 104. In some embodiments, the expansion sleeve 118 has a hoop strength that is less than 50% of the hoop strength of the expandable liner 104. In some embodiments, the expansion sleeve 118 is not continuous around the periphery of the casing 116. However, the expansion sleeve 118 may have sufficient axial strength to retain the cones segments 132 when the inner core 130 moves downward to form the expansion cone 134. In some embodiments, the expansion sleeve 118 holds the expandable liner 104 coupled to the outer casing 116 during expansion of the expandable liner 104. In some embodiments, the expansion sleeve 118 may comprise a collet having a plurality of fingers extending therefrom and engaging an outer groove on the expandable liner 104.

The inner string assembly 106 will continue moving and the expansion cone 134 will radially expand the expandable liner 104 into engagement with the wall of the wellbore. The inner string assembly 106 will continue moving as the shoe latch 112 engages the shoe 114. The inner string assembly 106 continues moving until the expansion cone 134 passes through and expands the entire length of the expandable liner 104. In certain embodiments, the outer casing 116 may include a stop member or other feature that limits the axial travel of the inner string assembly 106 relative to the outer casing 116.

As the expansion cone 134 passes out of the expandable liner 104, the cone segments 132 can move off of the inner cone 130 to collapse the expansion cone 134. Once the expandable liner 104 is fully expanded and the expansion cone 134 is collapsed, the expansion assembly 102 can be pulled upward by applying tension to the safety sub 140 via the conveyance. The expansion sleeve 118 decouples from the expandable liner 104. The cone assembly 110, including the shoe 114, can be pulled back through the expandable liner 104 and pulled to the surface along with the inner string assembly 106, the outer casing 116, and the expansion sleeve 118. In some embodiments, the expansion sleeve 118 may decouple from the outer casing 116 instead and may remain in the wellbore, coupled to the expandable liner 104. The expansion cone 134 can also be collapsed by applying tension to the inner string assembly 106 during expansion of the expandable liner 104 if a situation arises that necessitates retrieval of the expansion assembly 102 prior to full expansion of the expandable liner 104. The expansion operation may be repeated with other expandable liners.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A system comprising:

an outer casing;

an inner string assembly, wherein the inner string assembly includes a seal member in sealing engagement with the outer casing;

an expansion sleeve coupled to an end of the outer casing;

an expandable tubular having a first end coupled to the expansion sleeve and a second end coupled to a shoe;

a cone assembly coupled to the inner string assembly, wherein the cone assembly is positioned proximate to the expansion sleeve and disengaged from the shoe when the inner string is in a run-in-hole position; and a safety sub assembly coupled to an upper end of the outer casing and including a coupling for connection to a conveyance.

2. The system of claim 1 wherein the expansion sleeve comprises slots or holes that reduce a hoop strength of the expansion sleeve.

3. The system of claim 1 wherein the expansion sleeve comprises a material that has a strength lower than a strength of the expandable tubular.

4. The system of claim 1 wherein the cone assembly comprises an expansion cone and a shoe latch, wherein the shoe latch is operable to engage the shoe once the expandable tubular has been expanded.

5. The system of claim 4 wherein the expansion cone comprises an inner cone engaging cone segments to shift the expansion cone from a collapsed configuration to an expansion configuration.

6. The system of claim 5 wherein, in the expansion configuration, the expansion cone has an outer diameter that is greater than an outer diameter of the outer casing.

7. The system of claim 1 wherein the expandable tubular is an expandable liner.

8. The system of claim 1 further comprising a throughbore to circulate drilling fluid through the system.

9. The system of claim 1 further comprising a receptacle disposed in the inner string assembly along the throughbore to be engaged by an activation member dropped from surface.

10. A method, comprising:

assembling an expansion system, the expansion system comprising an outer casing, and an inner string assembly, wherein the inner string assembly includes a seal member in sealing engagement with the outer casing;

coupling a first expansion sleeve coupled to an end of the expansion system;

coupling a cone assembly to the expansion system, wherein the cone assembly is positioned proximate to the first expansion sleeve and disengaged from the shoe when the expansion system is in a run-in-hole position;

coupling one end of a first expandable tubular to the first expansion sleeve and a second end of the first expandable tubular to a shoe;

connecting the expansion system to a conveyance;

positioning the first expandable tubular in a wellbore with the conveyance;

shifting an expansion cone of the cone assembly from a collapsed configuration to an expansion configuration in which the expansion cone has an outer diameter that is greater than an outer diameter of the outer casing;

expanding the first expandable tubular in the wellbore to an expanded diameter and engaging the shoe with a shoe latch coupled to the expansion cone once the first expandable tubular is fully expanded; and passing the expansion cone out of the first expandable tubular and collapsing the expansion cone.

11. The method of claim 10 wherein the first expansion sleeve comprises slots or holes that reduce a hoop strength of the first expansion sleeve.

12. The method of claim 10 wherein the first expansion sleeve comprises a material that has a strength lower than a strength of the first expandable tubular.

13. A method, comprising:

assembling an expansion system, the expansion system comprising an outer casing, and an inner string assembly, wherein the inner string assembly includes a seal member in sealing engagement with the outer casing;

coupling a first expansion sleeve coupled to an end of the expansion system;

coupling a cone assembly to the expansion system, wherein the cone assembly is positioned proximate to the first expansion sleeve when the expansion system is in a run-in-hole position;

coupling a first expandable tubular to the first expansion sleeve;

connecting the expansion system to a conveyance;

positioning the first expandable tubular in a wellbore with the conveyance;

expanding the first expandable tubular in the wellbore to an expanded diameter;

shifting an expansion cone of the cone assembly from a collapsed configuration to an expansion configuration in which the expansion cone has an outer diameter that is greater than an outer diameter of the outer casing;

passing the expansion cone out of the first expandable tubular and collapsing the expansion cone pulling the expansion system to surface;

coupling a second expansion sleeve to the expansion system;

coupling a second expandable tubular to the second expansion sleeve; and passing the expansion system and the second expandable tubular through the first expandable tubular.

14. The method of claim 13, further comprising expanding the second tubular to the expanded diameter.

* * * * *